US008479381B2

(12) United States Patent
Daley

(10) Patent No.: US 8,479,381 B2
(45) Date of Patent: Jul. 9, 2013

(54) GRILL GRABBER

(76) Inventor: Marcus Daley, Leesburg, GA (US)

( * ) Notice: Subject to any disclaimer, the term of this patent is extended or adjusted under 35 U.S.C. 154(b) by 326 days.

(21) Appl. No.: 13/021,731

(22) Filed: Feb. 5, 2011

(65) Prior Publication Data

US 2011/0138597 A1 Jun. 16, 2011

(51) Int. Cl.
*B66C 1/00* (2006.01)

(52) U.S. Cl.
USPC ..... 29/760; 294/81.6

(58) Field of Classification Search
USPC ..... 29/426.1, 426.3, 426.5, 718, 721, 29/757, 760, 281.1; 294/81.6
See application file for complete search history.

(56) References Cited

U.S. PATENT DOCUMENTS

2010/0290876 A1* 11/2010 Conatser ..... 414/471

* cited by examiner

*Primary Examiner* — John C Hong
(74) *Attorney, Agent, or Firm* — Daniel Boudwin

(57) ABSTRACT

A lift frame for engaging and transporting a slatted vehicle grill. Two U-bolts extend from a rectangular frame with a crane lift point and a securing fastener. The U-bolts slideably slot between a pair vehicle grill slats while a fastener bolt clamps the U-bolts and slats together. Two locking clamps attach the lower frame rail to a second set of slats, securing the entire assembly against the vehicle grill for removal and transport. The frame provides a tool that improves safety and reduces effort required to lift a large vehicle radiator grill when access to the internal engine compartment is necessary for maintenance and repairs.

2 Claims, 3 Drawing Sheets

GRILL GRABBER

BACKGROUND OF THE INVENTION

1. Field of the Invention

The present invention relates to lifting devices and frames for safely removing and installing slatted radiator grills from large trucks or military vehicles.

2. Description of the Prior Art

Large commercial trucks, industrial vehicles and military vehicles are equipped with very large engine compartments and complementing radiator grills. These grills are used as a barrier against incoming discrete source debris such as stones and other projectiles that can cause internal damage. Heavily armored military vehicles that are designed to withstand blast loading from Improvised Explosive Devices (IEDs) and land mines, like those currently serving in conflicts abroad, utilize substantially-armored radiator grills that are extremely large and difficult to handle.

The Mine Resistant Ambush Protected (MRAP) vehicle is a vehicle of this type: an extensively armored vehicle that utilizes a heavily armored solution and large ground clearance to protect occupants and internal components such as the vehicle drive train and engine bay from exterior explosives. The radiator grill of these vehicles is similarly armored, and can weigh upwards of several hundred pounds in solid steel.

Removing, lifting and transporting such a component from the chassis of an MRAP can be considerably complicated and dangerous, given the size and distance these engine bays are positioned above the ground. Removal is necessary for maintenance and repair or certain components inside the engine bay, or when the grill itself is damaged. Removing such a large component requires several people and tools. Traditional ways of removal include haphazard methods and makeshift tools. The use of brute tool and method is required that allows safe removal and transport of such a heavy force to pull the grill from the front of the vehicle is also a common method. These can damage the grill and endanger the lives of mechanics and other personnel working in the area. A new grill removal tool and method is required to protect mechanics and servicemen when removing these large grills for maintenance and repairs.

SUMMARY OF THE INVENTION

In view of the foregoing disadvantages inherent in the known types of vehicle grill lift frames now present in the prior art, the present invention provides a new vehicle grill lift frame wherein the same can be utilized for providing convenience to the user when removing and installing a slatted grill on a large truck or military vehicle.

It is therefore an object of the present invention to provide a frame that slideably engages a slatted vehicle grill using two U-bolts, a rectangular frame, and a crane hoist lift point.

Another object of the present invention is to provide a tool that improves the control and safety of the process of removing large vehicle grills.

Yet another object of the present invention is to provide a tool that reduces time and effort required to lift and transport large vehicle grills.

Other objects, features and advantages of the present invention will become apparent from the following detailed description taken in conjunction with the accompanying drawings.

BRIEF DESCRIPTIONS OF THE DRAWINGS

DETAILED DESCRIPTION OF THE INVENTION

Figure 1:
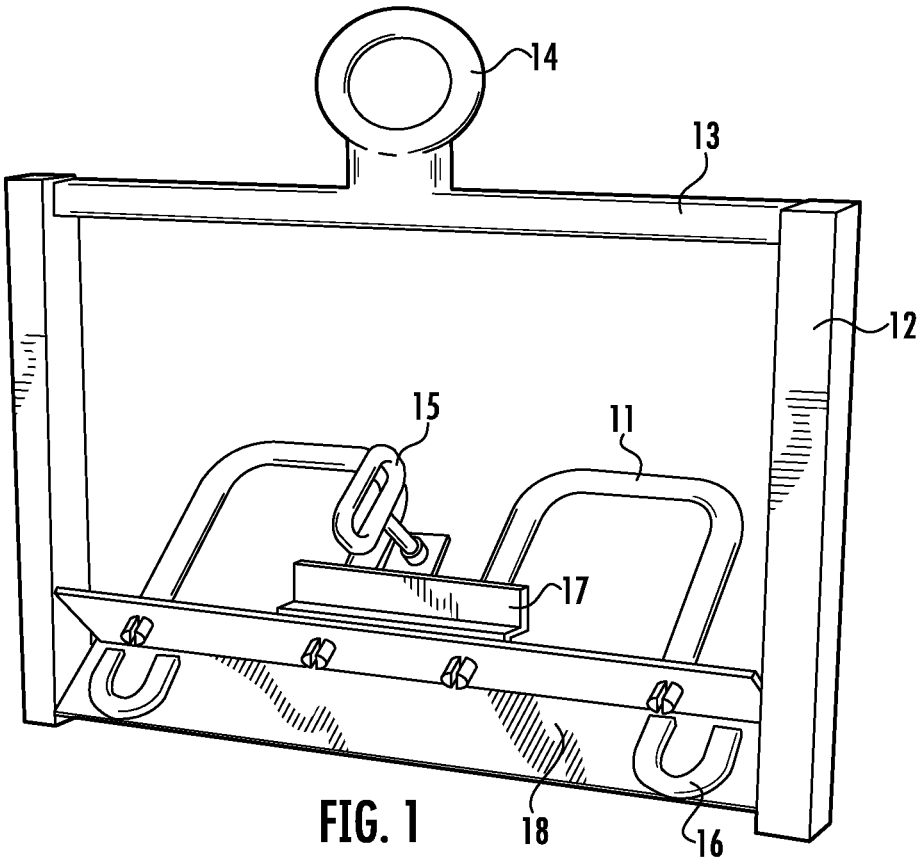
FIG. 1 shows an isometric view of the vehicle grill lift frame.

Referring now to FIG. 1, there is shown an isometric view of the vehicle grill lift frame. A rectangular frame composed of two vertical supports 12, an upper support 13 and a lower frame rail 18 are used as a frame for supporting lift loads from a large slatted vehicle grill. Two protruding U-bolts 11 integrally fit into the lower frame rail 18 and are cantilevered from the frame. The U-bolts 11 slideably engage two angled slats of a vehicle grill. A clamping bolt 15 is supported and threaded into a secondary angle bracket 17, and is used to clamp the vehicle grill slates between the clamping bolt 15 and the extended U-bolts 11 for a snug fit. On the lower leg of the lower frame rail 18 are two clamping points 16. These are reinforced positions on the lower frame rail 18 that support external clamping tools for securing the lower portion of the frame to a second set of vehicle slats. Along the upper support 13 is an integral lifting eye 14 that provides an external hoist point on the frame. The lifting eye 14 supports external hooks or pull-through straps. All sections of the frame may be integrally formed, fastened or welded together.

Figure 2:
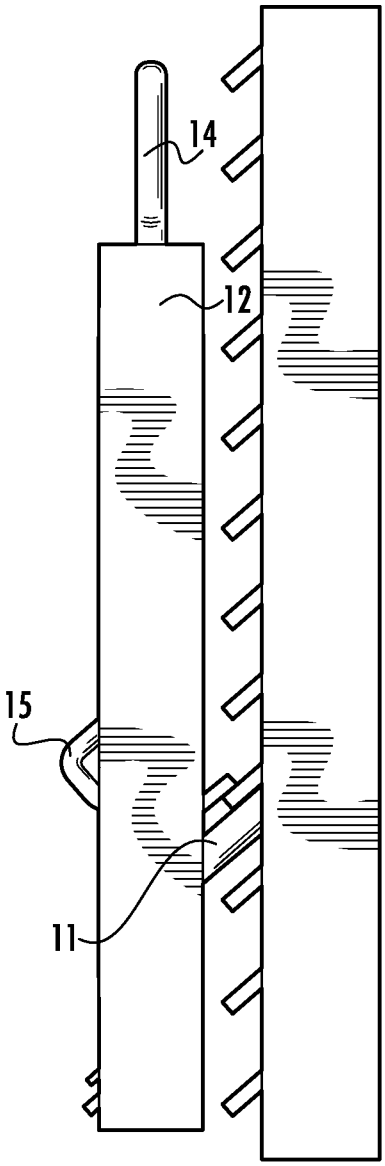
FIG. 2 shows a side view of the vehicle grill lift frame.

Referring now to FIG. 2, there is shown a side view of the vehicle grill lift frame. U-bolts 11 are cantilevered outward from the frame to engage a slatted grill, while the vertical supports 12 rest against the outboard edge of a grill after engagement. The lifting eye 14 is a secure hoist point, and is comprised of a circular member of round cross-section.

Figure 3:
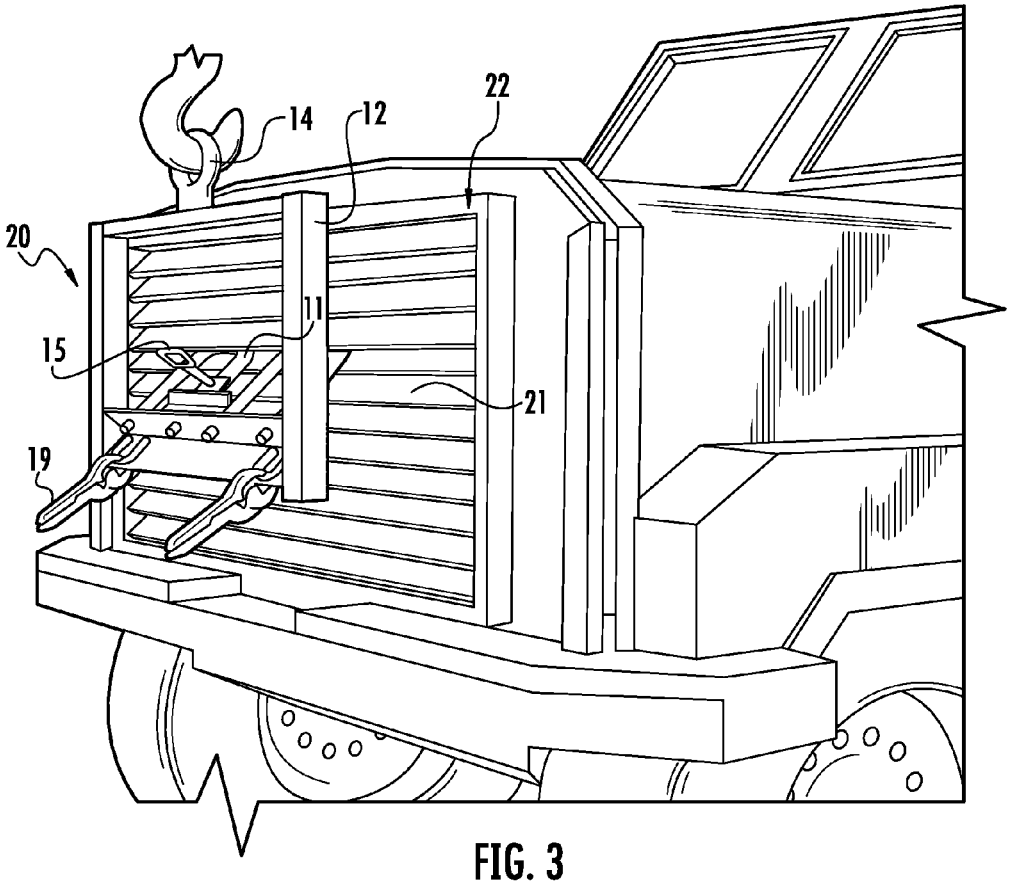
FIG. 3 shows the vehicle grill lift frame engaging a large slatted vehicle grill.

Referring now to FIG. 3, there is shown a view of the vehicle grill lift frame 20 engaging the angled slats of a large military vehicle 22. The two U-bolts 11 engageably slide between two upper grill slats 21 until the vertical supports 12 are flush against the grill 22 outer extent. The clamping bolt 15 is tightened, clamping the U-bolts 11 against the engaged slats 21 to provide secure fitment. A set of two external locking clamps 19 attach to the lower portion of the lift frame 20 at the clamping points 16. These clamps fasten together a second pair of grill slats to the lower frame rail 18, creating a backup for the U-bolt 11 and clamping bolt 15. This secondary clamping also prevents rocking or separation of the frame 20 with respect to the grill as it is being lifted. This second clamping position provides a point to react overturning moments by way of a couple, preventing the grill from rotating about the U-bolt/clamping bolt 11/15 interface. A crane hook or strap is secured to the lifting eye 14 and lifts the entire assembly away from the vehicle, safely and in a controlled manner.

In use an individual mechanic or a team of personnel work together to position the lift frame onto the vehicle grill, using a crane or overhead hoist mechanism. The size of the frame and the height of typical military vehicles may necessitate a lifting device for operation. Typical applications of the frame are in the military mechanic arena, however those industrial and commercial vehicles with large, slatted grills will benefit through the use of such a lift frame.

Fitment to a particular frame can be accommodated using a series of shims to remove gaps, or by creating a lift frame that is custom fit to a specific vehicle grill. The angle between the vertical support frames 12 and the U-bolts 11 will vary depending upon application, and can be adjusted during the frame manufacturing. Materials for the frame may consist of any structurally sufficient material to handle the lifting loads for the vehicle grill. These may include various metallics such as steel, aluminum or iron, or may include use of lightweight, fiber-reinforced, laminated or woven composites. The use of a composite or aluminum frame eliminates the need for a crane or hoist to position the lift frame against the grill. A single mechanic can lift frames of these materials single-handedly, however the cost and the structural stability becomes a topic to consider and analyze. Specific gauges, lengths and materials are dependent upon the application.

When the lift frame is engaged with first and second set of slats, using the threaded clamping bolt 15 and locking clamps 19, it is secured against the grill. A support crane hook or hoist is held taught against the lifting eye 14, and the grill itself is disassembled or released from the rest of the vehicle for transport. Keeping the lifting means taught ensures the grill will not fall inadvertently after release from the vehicle, preventing personal injury and vehicle damage. The frame and the grill are taken away and may be disengaged from each other or left together for reattaching the grill to the vehicle after required maintenance or repairs have been completed.

The use of this tool for controlling the removal of a large vehicle grill greatly improves the safety of the operation, as well as reduces the time and effort required. The activity can be conducted quickly with only the frame itself, a lifting means such as a crane or hoist, and two locking clamps. Typical operations that drop the grill from the vehicle or pull it off the body using brute force are replaced with a controlled and orchestrated method.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A vehicle grill lift frame, comprising:

a rectangular frame, two cantilevered U-bolts for slideable engagement of a set of vehicle grill slats, a securing fastener for clamping said U-bolts and said vehicle grill slats together, clamping points along said rectangular frame for external clamping means to clamp a second set of vehicle grill slats, and an integral lifting eye.

2. A vehicle grill lift frame, comprising:

two vertical supports with a first and a second end, an upper support spanning horizontally between the first ends of said vertical supports, and a lower frame rail with an upper leg and a lower leg spanning horizontally between said vertical supports second end;

two U-bolts cantilever from said upper leg of said lower frame rail; a securing fastener mounts on a secondary angle bracket, which mounts on said upper leg of said lower frame rail;

two clamping points protrude from said lower leg of said lower frame rail, and an integral lifting eye extends from the upper support.

* * * * *